US007493782B2

(12) United States Patent
Daniels

(10) Patent No.: US 7,493,782 B2
(45) Date of Patent: Feb. 24, 2009

(54) WASHING MACHINE, OZONE DISSOLVING APPARATUS AND METHOD OF WASHING

(75) Inventor: Ralph Daniels, Auburn, NH (US)

(73) Assignees: JLA Limited, Ripponden (GB); Daniels Equipment Company, Auburn, NH (US)

( * ) Notice: Subject to any disclaimer, the term of this patent is extended or adjusted under 35 U.S.C. 154(b) by 621 days.

(21) Appl. No.: 11/010,932

(22) Filed: Dec. 13, 2004

(65) Prior Publication Data

US 2005/0251925 A1 Nov. 17, 2005

(30) Foreign Application Priority Data

May 11, 2004 (GB) ..... 0410405.5

(51) Int. Cl.
*B08B 3/00* (2006.01)
*B08B 3/12* (2006.01)

(52) U.S. Cl. ..... 68/5 R; 68/207; 68/200; 8/149.1

(58) Field of Classification Search ..... 8/149.1; 68/207, 208, 5 R
See application file for complete search history.

(56) References Cited

U.S. PATENT DOCUMENTS 5,241,720 A * 9/1993 Engel et al. ..... 8/158
5,404,732 A 4/1995 Kim
5,625,915 A 5/1997 Radler et al.
5,688,289 A 11/1997 Nishioka et al.
5,806,120 A 9/1998 McEachern
5,824,243 A * 10/1998 Contreras ..... 261/36.1
5,960,501 A 10/1999 Burdick
5,960,649 A 10/1999 Burdick
6,363,951 B1 * 4/2002 Wood ..... 134/102.2
6,506,309 B1 * 1/2003 Daniels et al. ..... 210/760
6,507,965 B2 1/2003 Kown
6,833,121 B2 * 12/2004 Cooper et al. ..... 422/186.19
2006/0096038 A1 * 5/2006 Daniels et al. ..... 8/158

FOREIGN PATENT DOCUMENTS

EP 1 138 818 A1 10/2001
EP 00001138818 10/2001
JP 00011137882 11/1997
JP 2003220292 A 8/2003
JP 20030220292 8/2003

OTHER PUBLICATIONS

International Search Report dated Mar. 4, 2005 (3 pages).

* cited by examiner

*Primary Examiner*—Michael Barr
*Assistant Examiner*—Rita R Patel
(74) *Attorney, Agent, or Firm*—Howard & Howard Attorneys PLLC

(57) ABSTRACT

A washing machine having a washing volume and a mixing chamber below the washing volume and fluid communication therewith by means of a drain outlet at the underside of the washing volume. The mixing chamber receives water from the mixing volume through the drain outlet. At least one sparger is disposed within the mixing chamber for connection to an ozone source to introduce ozone into the water within the mixing chamber. The sparger is configured to introduce at least some ozone into the water within the mixing chamber in a downward direction away from the washing volume.

6 Claims, 4 Drawing Sheets

WASHING MACHINE, OZONE DISSOLVING APPARATUS AND METHOD OF WASHING

The present invention relates to a washing machine, an ozone dissolving apparatus and a method of washing which use ozone to disinfect laundry.

Washing of laundry is an expensive procesa, It utilises costly resources—water, energy, detergents and labour. It is often required to disinfect laundry items. While conventional detergents and soap can be effective in removing dirt and other contaminants, they are not always effective at killing bacteria. It is known to enhance a washing machine by introducing ozone into the washing water. The ozone improves the cleaning at low wash temperatures and has an antibacterial effect.

Previous systems for introducing ozone have included a simple bubble system in which ozone is bubbled through water in a washing machine drum. The efficiency of dissolving ozone in such apparatus is low, and the concentration of dissolved ozone in the water is consequently low resulting in only a small enhancement in cleaning and low antibacterial effect. There is also the disadvantage that the amount of off-gas can be considerable. This gas will collect in the area surrounding the washing machine and can have health and safety limitations if people are exposed to high concentrations of ozone.

In order to improve the efficiency with which ozone is dissolved in the water, systems using venturis have been developed. These forcibly dissolve ozone in the water and improve the concentration of dissolved ozone. However, the systems are complex and often require major changes to the pipework of the washing machine in order to install them.

Additional space is also required for the venturi itself and associated components such as tanks and pumps.

It is an object of the present invention to efficiently dissolve ozone in water used in a washing machine without having to make substantial changes to the pipework connected to the washing machine.

Accordingly, in a first aspect there is provided a washing machine comprising:

a washing volume and a mixing chamber below the washing volume and in fluid communication therewith; and at least one sparger within the mixing chamber for connection to an ozone source.

The mixing chamber can be smaller than the washing volume since it need only contain the sparger rather than the sparger and any laundry. When the mixing volume is not much larger than the sparger passing ozone through the sparger can produce strong currents in the mixing volume. This results in active circulation of ozone containing water in and out of the mixing chamber and hence throughout the washing volume.

Preferably, the washing machine comprises an ozone source connected to the sparger.

Preferably, the washing volume and mixing chamber are in fluid communication by means of a drain outlet in the washing volume. The drain outlet can be in the underside of the washing volume. This ensures that the mixing chamber fills before the washing volume.

The washing machine can further comprise a drain valve extending between the drain outlet and mixing chamber.

The washing machine can further comprise a drain valve extending from the underside of the mixing chamber.

Preferably, the washing machine further comprises a controller for controlling flow of ozone to the sparger. The sparger can be arranged such that in use ozone exits the sparger downwardly. This increases the circulation of water within the mixing chamber and hence throughout the washing volume.

In a further aspect of the invention there is provided an ozone dissolving apparatus for a washing machine, the washing machine comprising a washing volume having a drain outlet in the washing volume wall, the apparatus comprising a mixing chamber having an aperture for connection to the drain outlet; and at least one sparger positioned within the mixing chamber and being for connection to an ozone source.

The apparatus according to the invention can be connected to the drain aperture of a standard washing machine allowing efficient addition of ozone to the wash without increase in complexity of the associated plumbing.

Preferably, the apparatus comprises a drain valve connected between the drain outlet and mixing chamber. The mixture chamber can comprise a drain valve.

In a further aspect of the invention there is provided a method of washing comprising providing a washing machine, the washing machine comprising:

a washing volume and a mixing chamber below the washing volume and in fluid communication therewith; and at least one sparger within the mixing chamber for connection to an ozone source;

at least partially filling the mixing chamber with water so as to submerge the sparger; and dissolving ozone gas in the water by passing ozone through the sparger.

The ozone can be passed downwardly through the water.

Preferred embodiments of the present invention will now be described, by way of example only and not in any limitative sense, with reference to the appended drawings in which.

Figure 1:
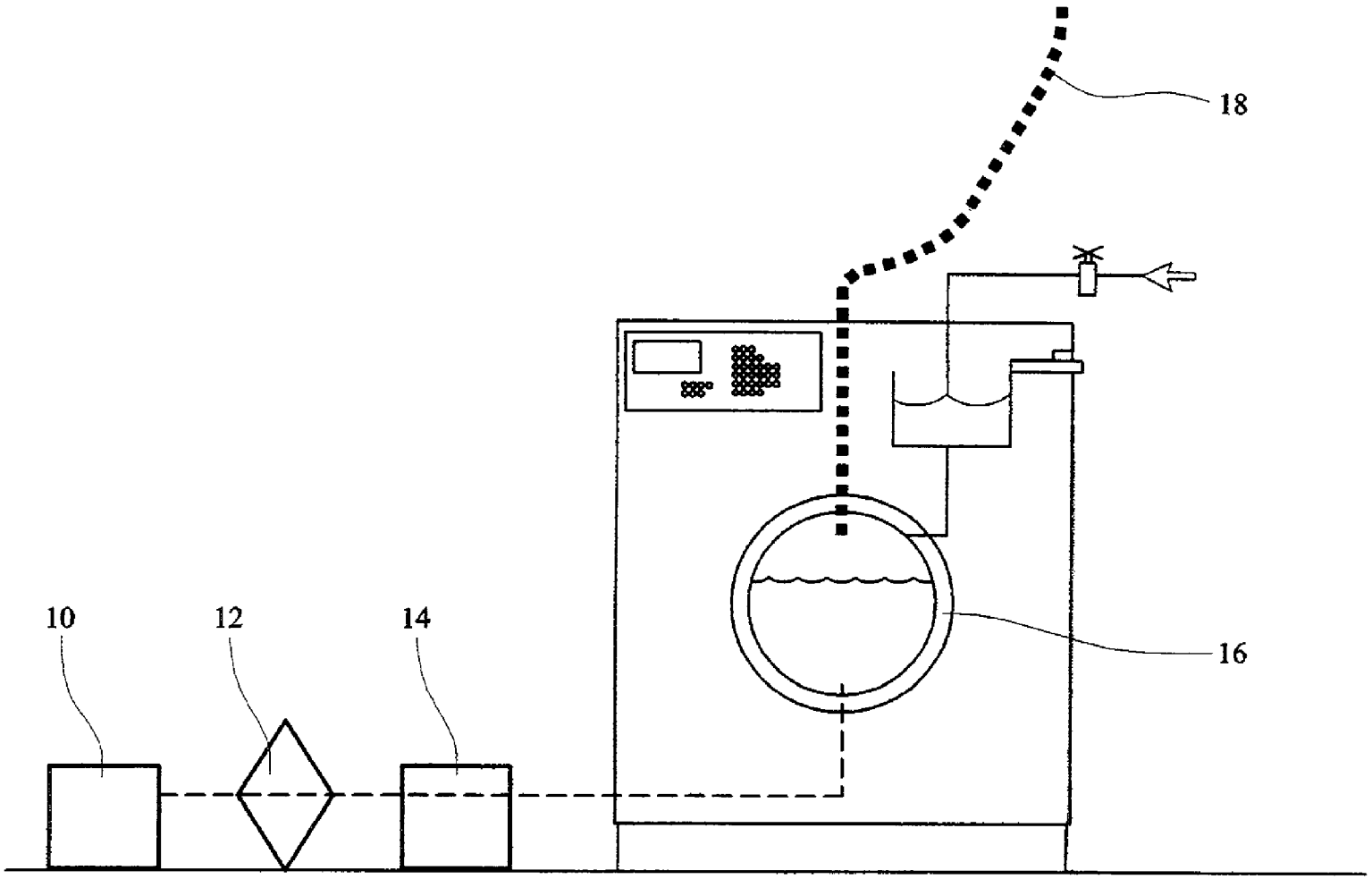
FIG. 1 PRIOR ART
FIG. 1 is a schematic diagram of known washing machine including an ozone source.

Shown in FIG. 1 is a schematic diagram of a known washing machine. A compressor 10 supplies air to an air preparation unit 12 which dries the air. The dried air is then passed to an ozone generator 14. The ozone generation 14 then supplies ozone gas through an inlet to a washing machine drum. The gas bubbles through the water in the drum 16 and a small amount will dissolve. The efficiency of dissolving ozone in the water is however low.

Figure 2:
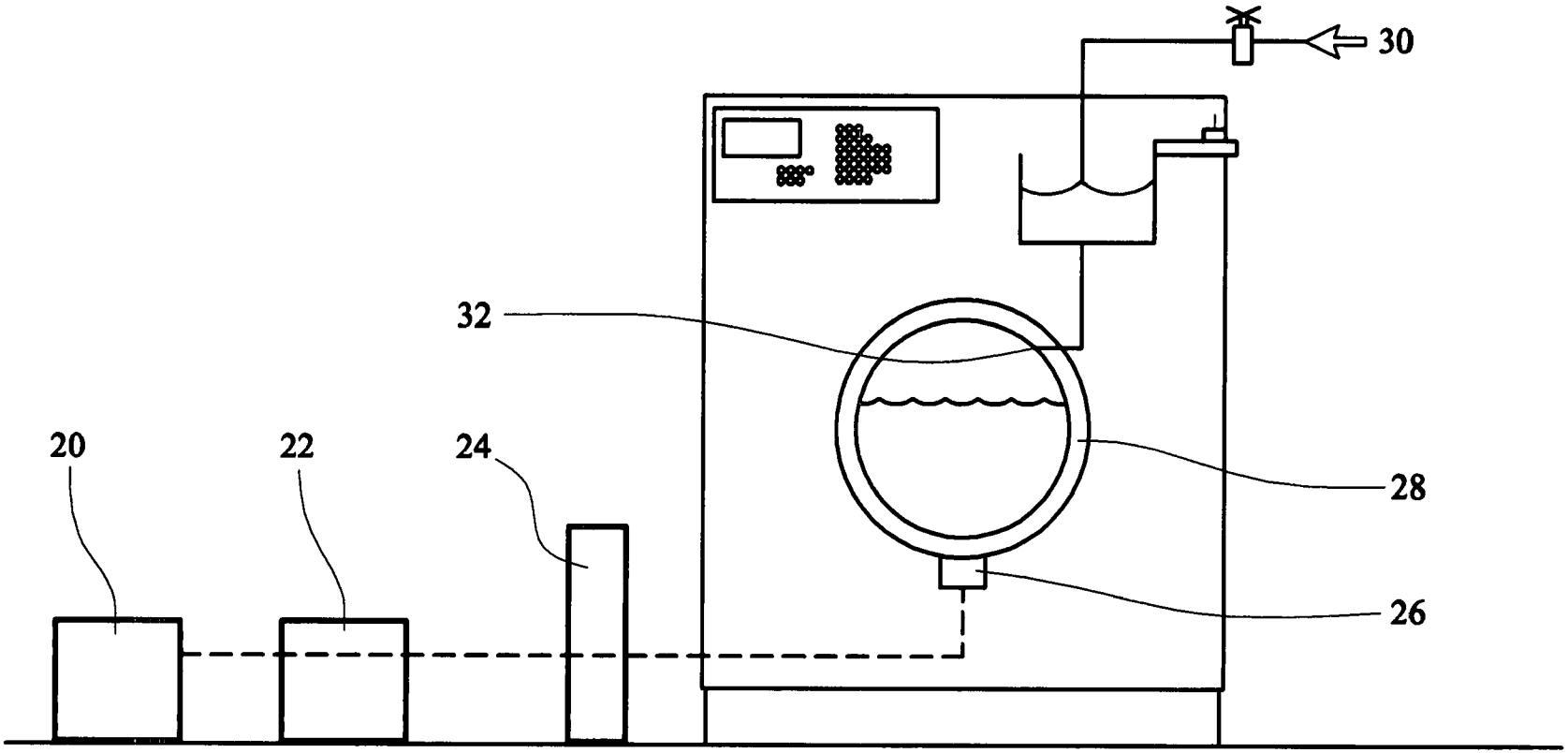
FIG. 2 is a schematic diagram of a washing machine according to the present invention.

A first embodiment of a washing machine according to the invention is depicted in FIG. 2. An oxygen generator 20 generates oxygen which is supplied to an ozone generator 22. The ozone is then supplied through a controller 24 which controls the supply of ozone into a mixing chamber 26.

An aperture of the mixing chamber is connected to a drain outlet in the washing volume. The drain outlet of this embodiment is arranged at the lowest point of the washing volume. A drain valve (not shown) extends from the underside of the mixing chamber allowing the washing volume to be separated if required. Water from a water supply 30 is supplied to an inlet 32 towards the top of the washing volume.

Figure 3:
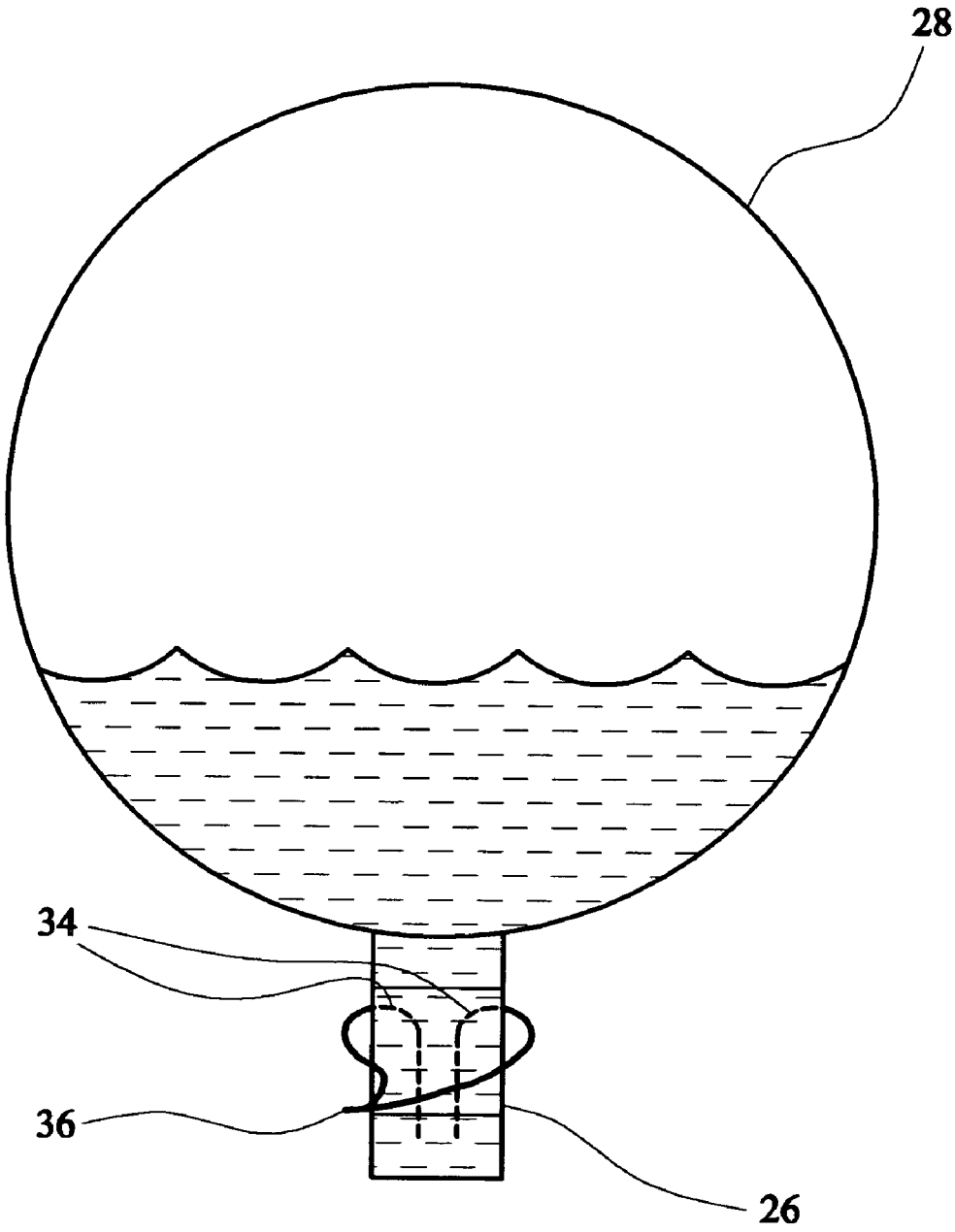
FIG. 3 is a close up showing the construction of the mixing chamber of the washing machine in FIG. 2.

As can be seen in FIG. 3, the mixing chamber is arranged below the washing volume. Accordingly, as water is added to the washing volume it drains to the mixing chamber which fills before the washing volume.

The mixing chamber 26 contains two spargers 34. These spargers each have the form of a perforated pipe and are pointed towards the bottom of the mixing chamber 26. Ozone is supplied into the spargers 34 by gas pipes 36.

In use, a user inserts laundry to be washed into a drum 28 within the primary washing volume. The drain valve is closed and water is supplied into the drum 28 by the water supply 30. When the drain valve closes, the ozone supply controller 24 receives a signal that the drain valve is closed and begins the supply of ozone to the spargers 34 in the mixing chamber 26, As ozone is supplied to the spargers 34 it escapes through the perforations in the sides of the spargers and also through the downward facing ends. This causes water to circulate in the mixing chamber 26 resulting in efficient mixing of the water in the mixing chamber with the ozone. Furthermore, because the spargers 34 are angled downwards, the ozone emerging from the ends must move upwards through the height of the mixing chamber and washing volume. This enhances the dissolving of ozone by ensuring it is in contact with water for as much of the process as possible, and also results in improved circulation of water into and out of the mixing chamber 26.

The washing machine then commences a normal washing cycle and ozone is supplied by the controller throughout the entire period when the drain valve is closed to ensure that ozone dissolved in the water is continually regenerated.

During the washing cycle, the drum 28 of the washing machine rotates to agitate the laundry. This enhances the cleaning and also enhances the circulation the water into and out of the mixing chamber 26.

It will be appreciated that although this embodiment uses two spargers, any number may be used in alternative embodiments of the present invention.

In an alternative embodiment of the invention, the mixing chamber is located separately from the drain outlet. It is still located below the washing volume to ensure that it is submerged in water from an early point in the washing cycle.

In a further embodiment of the invention there is a drain valve connected between mixing chamber and washing volume allowing the ozone system to be simply disconnected if required.

Figure 4:
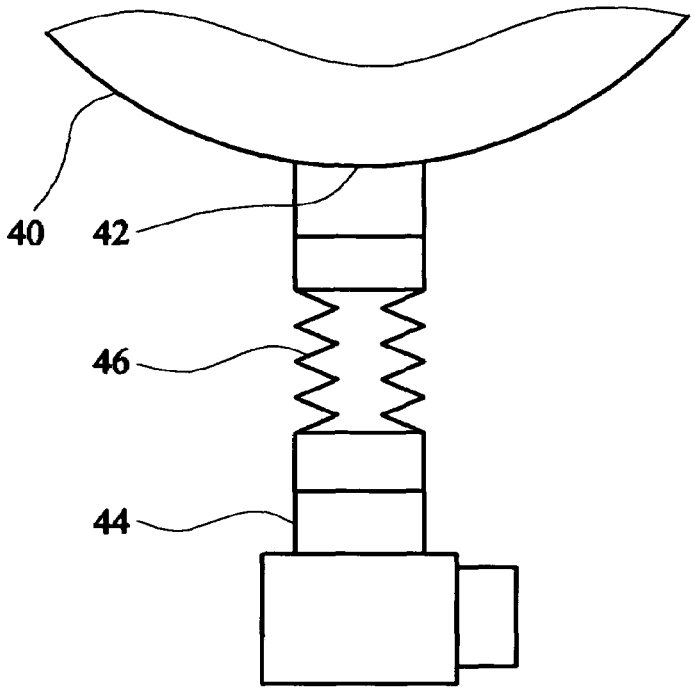
FIG. 4 is a diagram of known connection between a washing machine container and the drain.
Figure 5:
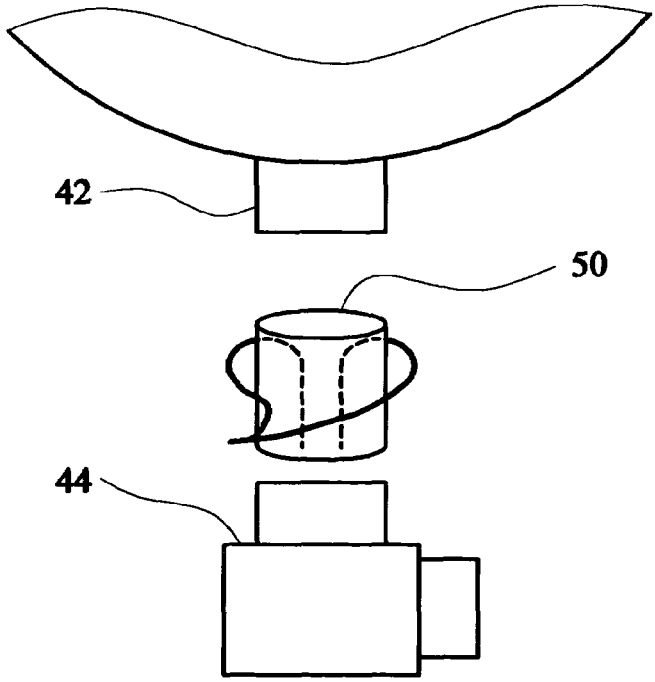
FIG. 5 shows the connection of an ozone dissolving apparatus according to the invention to the washing machine depicted in FIG. 4.

An embodiment of the ozone dissolving apparatus according to the invention is illustrated in FIG. 5. This embodiment provides a mixing chamber which can be retrofitted into existing washing machines. FIG. 4 illustrates schematically the connection to the drain outlet of a conventional washing machine. The primary washing volume has a drain outlet 42 which is connected to a drain valve 44 by a connecting pipe 46. The drain valve is controlled during the washing machine cycle to cause water to collect in the primary washing volume, or drain away from the primary washing volume.

As illustrated in FIG. 5 the mixing chamber of this embodiment is adapted to be fitted between the drain outlet 42 and the drain valve 44. The supply of ozone to the mixing chamber 50 is as was described for the first embodiment. Thus this embodiment easily allows an existing washing machine to be adapted to include an ozone dissolving system.

In the above embodiments, the ozone dissolving chamber is constructed from stainless steel. However, it will be appreciated that other materials which are gas and water tight and have good corrosion resistance properties could also be used.

The invention claimed is:

1. A washing machine comprising:

a washing volume and a mixing chamber below the washing volume and in fluid communication therewith by means of a drain outlet at the underside of the washing volume, wherein the mixing chamber is configured to receive water from the washing volume through the drain outlet;

at least one sparger within the mixing chamber for connection to an ozone source to introduce ozone into the water within the mixing chamber, wherein ozone containing water within the mixing chamber is capable of circulating between the washing volume and the mixing chamber through the drain outlet; and wherein the sparger is configured to introduce at least some ozone into the water within the mixing chamber in a downward direction away from the washing volume.

2. A washing machine as claimed in claim 1 further comprising an ozone source connected to the sparger.

3. A washing machine as claimed in claim 1 further comprising a drain valve with the mixing chamber positioned between the drain outlet and the drain valve.

4. A washing machine as claimed in claim 1, further comprising a drain valve extending from the underside of the mixing chamber.

5. A washing machine as claimed in claim 1, further comprising a controller for controlling flow of ozone to the sparger.

6. A washing machine as claimed in claim 1 further comprising two spargers each having a downward facing end from which to introduce ozone in to the water within the mixing chamber.

* * * * *